US011376179B1

(12) United States Patent
Gao

(10) Patent No.: US 11,376,179 B1
(45) Date of Patent: Jul. 5, 2022

(54) MULTIFUNCTIONAL NURSING MATTRESS

(71) Applicant: FOSHAN HONGFENG MEDICAL TECHNOLOGY CO., LTD, Foshan (CN)

(72) Inventor: Bo Gao, Foshan (CN)

(73) Assignee: FOSHAN HONGFENG MEDICAL TECHNOLOGY CO., LTD, Foshan (CN)

( * ) Notice: Subject to any disclaimer, the term of this patent is extended or adjusted under 35 U.S.C. 154(b) by 0 days.

(21) Appl. No.: 17/371,060

(22) Filed: Jul. 8, 2021

(51) Int. Cl.
*A61G 7/057* (2006.01)
*A61G 7/00* (2006.01)

(52) U.S. Cl.
CPC ..... *A61G 7/05776* (2013.01); *A61G 7/001* (2013.01); *A61G 2200/327* (2013.01); *A61G 2203/34* (2013.01)

(58) Field of Classification Search
CPC ..... A61G 7/05776; A61G 7/001; A61G 2200/327; A61G 2203/34
See application file for complete search history.

(56) References Cited

U.S. PATENT DOCUMENTS 4,456,034 A * 6/1984 Bixby ..... F16L 11/118 138/103
4,527,298 A * 7/1985 Moulton ..... A61G 7/018 5/615
5,267,364 A * 12/1993 Volk ..... A61G 7/05776 5/710
5,611,096 A * 3/1997 Bartlett ..... A61G 7/001 5/424
6,681,425 B2 * 1/2004 Leventhal ..... A47C 20/048 5/616
6,684,425 B2 * 2/2004 Davis ..... A47C 20/048 5/615
6,739,005 B2 * 5/2004 Davis ..... A47C 20/048 5/613
7,080,422 B2 * 7/2006 Ben-Levi ..... A61G 7/001 5/615
D543,407 S * 5/2007 Thom ..... D6/604
7,346,951 B1 * 3/2008 Heaton ..... A61G 7/008 5/615
9,566,202 B2 * 2/2017 Chiang ..... A61G 7/0525
2005/0268401 A1 * 12/2005 Dixon ..... A61G 7/008 5/655.3
2006/0026767 A1 * 2/2006 Chambers ..... A61G 7/0514 5/713
2008/0099277 A1 * 5/2008 Liu ..... B25F 5/00 181/230
2008/0235872 A1 * 10/2008 Newkirk ..... A61G 7/018 5/600

(Continued)

*Primary Examiner* — Myles A Throop

(57) ABSTRACT

A multifunctional nursing mattress, which includes a mattress main body. The mattress body includes a plurality of inflatable bags arranged in parallel with each other, a mattress cover for wrapping the plurality of inflatable bags, a back lifting inflatable bag, a left-side overturning inflatable bag, a right-side overturning inflatable bag and a foot lifting inflatable bag arranged under the mattress main body. The anti-bedsore mattress of the present invention has the advantages of simple structure and reasonable design, and can realize the functions of back lifting, turning over and foot lifting, which is advantageous for the user to adjust the body posture and has the preventive effect on bedsore.

11 Claims, 8 Drawing Sheets

(56) References Cited

U.S. PATENT DOCUMENTS

| | | | | |
|---|---|---|---|---|
| 2008/0263763 | A1* | 10/2008 | Butler | A61G 7/05715<br>5/81.1 R |
| 2009/0144909 | A1* | 6/2009 | Skinner | A61G 7/05776<br>5/713 |
| 2012/0222214 | A1* | 9/2012 | Lachenbruch | A61G 7/001<br>5/81.1 R |
| 2012/0259248 | A1* | 10/2012 | Receveur | A61B 5/1118<br>600/595 |
| 2015/0164720 | A1* | 6/2015 | Gibson | A61G 7/05769<br>5/83.1 |
| 2015/0320960 | A1* | 11/2015 | Barlow | A61M 16/021<br>128/204.21 |
| 2019/0344894 | A1* | 11/2019 | Bang | B64D 11/0648 |

* cited by examiner

MULTIFUNCTIONAL NURSING MATTRESS

TECHNICAL FIELD

The present invention relates to the field of air bed, in particular to a multifunctional nursing mattress.

BACKGROUND

Bedsore is a common complication, which occurs in patients who have been in bed for a long time. Since the body has long contact with the mattress, especially the back and buttocks of the body, it is difficult to turn over, so that blood circulation is stuck, and the pus cells grow and the bedsore grows. Bedsore not only affects the recovery of patients, increases the sufferings of patients, but also brings more burdensome treatment and nursing work.

Thus, there are a variety of anti-bedsore mattresses on the market, the most used is the anti-bedsore air bed. Air bed is widely used in medical treatment, accompanying and auxiliary rehabilitation training. It is suitable for patients who are bedridden for a long time and the elderly who are less active. Through the inflation and deflation of the inflatable bag, the massage effect can be achieved, so as to avoid bedsore for patients or the elderly who are bedridden for a long time.

Although the traditional air bed can play a certain role in the prevention of bedsore, the traditional air bed only plays the role of massage and can not adjust the posture of the user, resulting in poor prevention effect of bedsore. At the same time, it also increases the workload of the caregivers, especially when the patient needs to get up, lift his legs or turn over, the caregivers need to rely on manpower to change the user's posture, which is also easy to cause discomfort to the user.

SUMMARY

In view of the above problems, the present invention provides a multifunctional nursing mattress, and the specific technical solution is as follows:

A multifunctional nursing mattress is provided, which includes a mattress body, wherein the mattress body is divided into a head rest area, a back rest area and a leg rest area according to a position of human body lying flat on the mattress body; the mattress body includes a plurality of inflatable bags arranged inside in parallel, a mattress cover wrapping the plurality of inflatable bags, and a back lifting inflatable bag, a left-side overturning inflatable bag, a right-side overturning inflatable bag and a foot lifting inflatable bag, wherein the back lifting inflatable bag, the left-side overturning inflatable bag, the right-side overturning inflatable bag and the foot lifting inflatable bag are arranged under the mattress body; an inflation device, wherein the inflation device is configured to inflate and deflate the plurality of inflation inflatable bags, the back lifting inflatable bag, the left-side overturning inflatable bag, the right-side overturning inflatable bag and the foot lifting inflatable bag, comprising a first inflation tube, a second inflation tube, a back lifting inflation tube, a left-side overturning inflation tube, a right-side overturning inflation tube, a foot lifting inflation tube, and an air pump, a control unit for controlling the air pump; wherein, the inflation device does not inflate the left-side overturning inflatable bag or the right-side overturning inflatable bag at the same time, and when the inflation device inflates the left-side overturning inflatable bag or the right-side overturning inflatable bag, the foot lifting air tube of the foot lifting inflatable bag is cut off by the inflation device; the air pump is provided with an air distribution valve communicated with the first inflation tube and the second inflation tube, the back lifting inflation tube, the left-side overturning inflation tube, the right-side overturning inflation tube and the foot lifting inflation tube respectively.

As a further improvement, the plurality of inflatable bags includes a first inflatable bag and a second inflatable bag, which are respectively communicated with the first inflation tube and the second inflation tube of the inflation device, and the first inflatable bag and the second inflatable bag are arranged at intervals.

As a further improvement, a back cushion is arranged in the back rest area of the upper surface of the mattress body, and the back cushion is connected with the mattress body through a regulating belt, so that the back cushion is able to move up and down in the back rest area of the mattress body.

As a further improvement, the shape of the back lifting inflatable bag after inflation is circular or triangular.

As a further improvement, both sides of the mattress body are also provided with a left inflatable pad and a right inflatable pad, and the left inflatable pad and the right inflatable pad are detachably installed on both sides of the mattress body; the inflation device further includes a left pad inflation tube and a right pad inflation tube for inflating the left inflatable pad and the right inflatable pad respectively, wherein the left pad inflation tube is communicated with the right-side overturning inflation tube, and the right pad inflation tube is connected with the right-side overturning inflation tube.

As a further improvement, the control unit includes a weight recording module, a posture selection module, a pressure control module and an alarm module, wherein the weight recording module is configured for inputting a weight of an user and sending the weight information of the user to the pressure control module; the posture selection module is configured to select a posture mode required by the user, and send the selected posture mode information to the pressure control module, wherein the posture mode includes the lying down mode, the back lifting mode, the left-side overturning mode, the right-side overturning mode and the leg lifting mode, respectively corresponding to the control of the inflation inflatable bags, the back lifting inflatable bag, the left-side overturning inflatable bag, the right-side overturning inflatable bag and foot lifting inflatable bag; the pressure control module is configured to control the air pump to perform preset inflation operation to the corresponding inflatable bag through the air distribution valve according to the weight information sent by the weight recording module and the posture mode information sent by the posture selection module, and the pressure control module is provided with an air pressure control sensor, an inflation process of the corresponding inflation tube is stopped when the air pressure reaches a preset value; the alarm module is configured to send an alarm information to the pressure control module when the inflation inflatable bag, the back lifting inflatable bag, the left-side overturning inflatable bag, the right-side overturning inflatable bag and the foot lifting inflatable bag of the inflation device or the air bed are abnormal.

As a further improvement, two independent holding bags are arranged on a lower surface of the mattress cover of the mattress body, and two base plates are respectively arranged in the two holding bags to increase a strength of the whole mattress body and support the mattress body, so as to avoid a deformation of the mattress body.

As a further improvement, a spring is built in a position of each inflation tube near the air distribution valve to avoid the tube bending, so as to maintain the tube shape and make the inflation device more miniaturized.

As a further improvement, an air inlet of the air pump of the inflation device is provided with silencing cotton to reduce the working noise.

As a further improvement, a silicone pad is arranged between a bottom of the shell of the inflation device and the air pump to slow down a vibration of the air pump.

As a further improvement, the plurality of inflation inflatable bags located in the head rest area and the back rest area are evenly divided into two parts along the midline of the mattress body, the two parts is foldable relative to each other, and the two parts are communicated with each other.

As a further improvement, a plurality of limit clips symmetrically arranged at the bottom of the mattress body are used to limit the inflation inflatable bag, a first buckle is arranged at both sides of the mattress body, and each inflation inflatable bag is transversely arranged inside the mattress body through the limit clips, and each inflation inflatable bag is provided with a second buckle, and the inflation inflatable bag is positioned by the first buckle and the second buckle.

As a further improvement, a detachable connector is arranged between the air distribution valve and each inflation tube, the connector is embedded on the shell of the inflation device, and the connector is provided with connection holes with the same number of the inflation tubes.

Compared with the prior art, the present invention has the advantages of:

The multifunctional nursing mattress provided by the present invention can realize back lifting, left and right-side overturning, foot lifting and other functions by setting back lifting inflatable bag, left-side overturning inflatable bag, right-side overturning inflatable bag and foot lifting inflatable bag, which is advantageous for the user to adjust body posture and has preventive effect on bedsore.

BRIEF DESCRIPTION OF THE DRAWINGS

In order to more clearly explain the technical scheme of the embodiment of the present invention, the attached drawings needed to be used in the embodiment will be briefly introduced below. It should be understood that the following drawings only show some embodiments of the present invention, so it should not be regarded as the limit of scope. For ordinary technical personnel in the art, without paying creative labor, other relevant drawings may also be obtained according to these drawings.

DETAILED DESCRIPTION OF THE EMBODIMENTS

Figure 1:
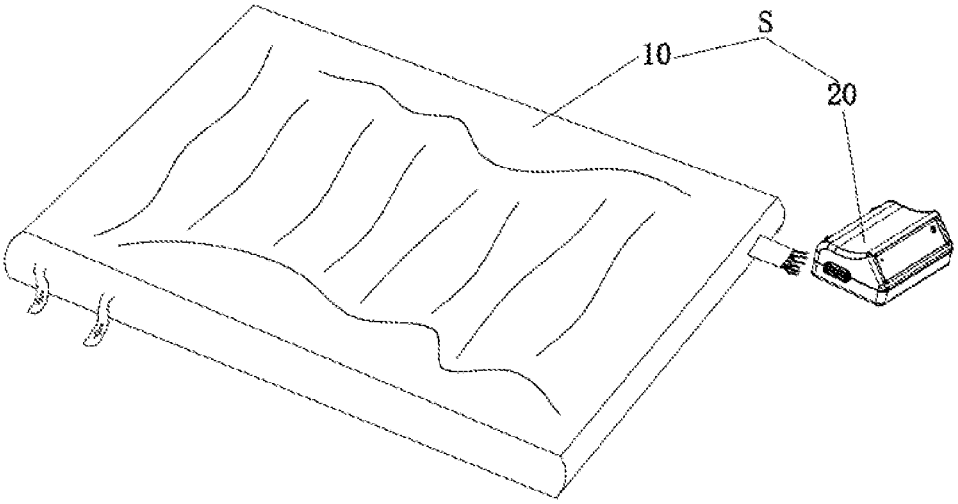
FIG. 1 is a structural schematic diagram of a multifunctional nursing mattress provided by the present invention.

In order to make the object, technical solution and advantages of the embodiments of the present invention clearer, the technical solution in the embodiments of the present invention will be described clearly and completely in combination with the drawings in the embodiments of the present invention. Obviously, the described embodiments is a part of the embodiments of the present invention, not all of the embodiments. Therefore, the following detailed description of the embodiments of the present invention provided in the drawings is not intended to limit the scope of the present invention required to be protected, but only represents the selected embodiments of the present invention. Based on the embodiments of the present invention, all other embodiments obtained by ordinary skilled person in the art without making creative work belong to the protection scope of the present invention.

In the present invention, unless otherwise specified and limited, the terms "installation", "connected", "connection" and "fixed" shall be understood in a broad sense. For example, it can be fixed connection, detachable connection or integrated connection; it can be mechanical connection or electrical connection; it can be directly connected, or indirectly connected through intermediate media, or the internal communication of two components, or the interaction between two components. For those skilled in the art, the specific meaning of the above terms in the present invention can be understood according to the specific situation.

In the following, a kind of multifunctional nursing mattress provided by the present invention will be described in more detail in combination with a specific embodiment and related drawings.

Embodiment 1

As shown in FIG. 1, a multifunctional nursing mattress S is provided in this embodiment to assist posture adjustment, including a mattress body 10 and an inflation device 20 to inflate and deflate the mattress main body 10. As shown in the figure, the mattress body 10 is divided into a head rest area A, a back rest area B and a leg rest area C, which are divided according to the human position corresponding to the mattress body 10 when the human body lies flat on the mattress body 10.

Figure 2:
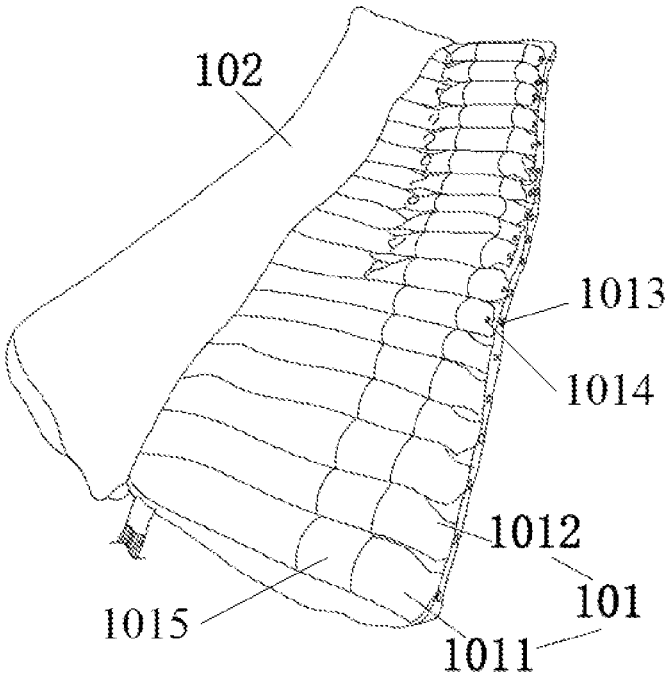
FIG. 2 is the structural schematic diagram of the multifunctional nursing mattress provided by the present invention (part of the mattress cover is hidden)
Figure 3:
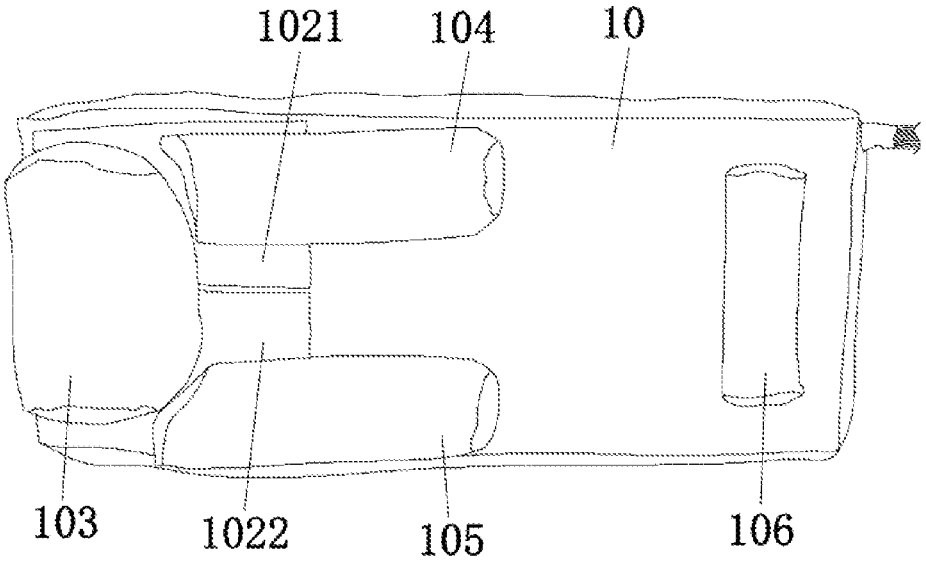
FIG. 3 is the structural schematic diagram from the bottom view angle of the multifunctional nursing mattress provided by the present invention (part of the mattress cover is hidden)

Referring to FIG. 2, the mattress body 10 includes a plurality of inflatable bags 101 arranged inside in parallel to each other and a mattress cover 102 wrapping the plurality of inflatable bags 101. Referring to FIG. 3, a back lifting inflatable bag 103, a left-side overturning inflatable bag 104, a right-side overturning inflatable bag 105 and a foot lifting inflatable bag 106 are arranged under the mattress body 10.

The back lifting inflatable bag 103 is arranged in the area between the head rest area A and the back rest area B for lifting the head, neck and upper body, the left-side overturning inflatable bag 104 and the right-side overturning inflatable bag 105 are arranged in the back rest area B and are respectively located on both sides of the back rest area B for assisting the body to turn over to one side, and the foot lifting inflatable bag 106 is arranged at the end of the leg rest area C away from the back rest area B for lifting the legs. As shown in FIG. 3, the back lifting inflatable bag 103 and the foot lifting inflatable bag 106 are arranged in parallel with each other, the left-side overturning inflatable bag 104 and the right-side overturning inflatable bag 105 are arranged along the length direction of the air bed and are arranged in perpendicular with the back lifting inflatable bag 103 and the foot lifting inflatable bag 106.

The shape of the back lifting airbag 103 after inflation is circular or triangular. Preferably, in this embodiment, the back lifting airbag 103 is in the form of a circular after inflation. According to the actual design experiment, although the triangle airbag structure can meet the lifting effect, because the triangle airbag structure has a large bottom area, it needs more inflation amount to achieve the same lifting effect than the circular airbag structure, so it needs more inflation time than the circular airbag structure.

Figure 4:
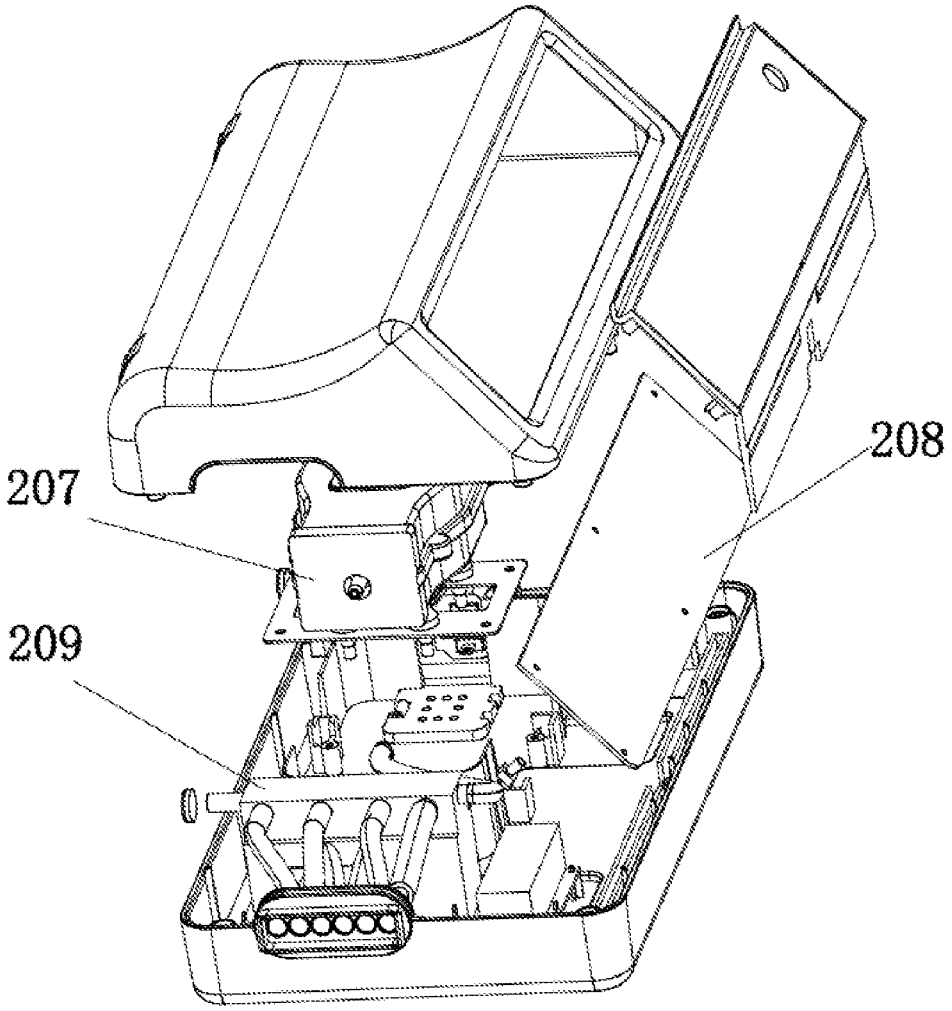
FIG. 4 is a structural diagram of an inflation device of the multifunctional nursing mattress provided by embodiment 1.

As shown in FIG. 4, the inflation device 20 is used to inflate and deflate the plurality of inflatable airbags 101, the back lifting inflatable airbag 103, the left-side overturning inflatable airbag 104, the right-side overturning inflatable airbag 105 and the foot lifting inflatable airbag 106. The inflation device 20 includes a first inflation tube 201, a second inflation tube 202, a back lifting inflation tube 203, a left-side overturning inflation tube 204, a right-side overturning inflation tube 205, a foot lifting inflation tube 206, an air pump 207, and a control unit 208 for controlling the air pump 207. In this embodiment, the air pump 207 is an electric air pump. Compared with the traditional mechanical air pump, the electric air pump can control each airbag of the air bed more accurately to achieve accurate inflating and deflating control, which is conducive to the miniaturization of the inflation device 20.

Referring to FIG. 4, the air pump 207 is also provided with an air distribution valve 209 communicated with the first inflation tube 201, the second inflation tube 202, the back lifting inflation tube 203, the left-side overturning inflation tube 204, the right-side overturning inflation tube 205 and the foot lifting inflation tube 206. A detachable connector is arranged between the air distribution valve 209 and each inflation tube, the connector is embedded on the shell of the inflation device 20. And the connector is provided with connection holes, the number of the connection holes is consistent with the number of inflation tubes. At the position close to the valve 209, a spring is built in the interior of the inflation tube, which is used to avoid the tube bending and maintain the tube shape, making the inflation device 20 more miniaturized.

In order to reduce the working noise, a silencing cotton is arranged at the air inlet of the air pump 207 of the inflation device 20. In addition, a silicone pad is arranged between the bottom of the shell of the inflation device 20 and the air pump 207 to slow down the vibration of the air pump 207.

Figure 5:
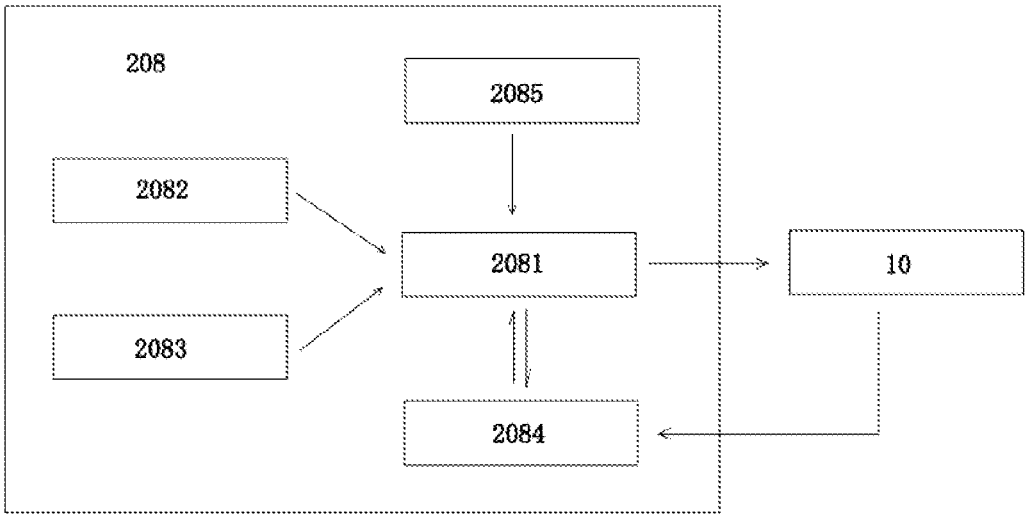
FIG. 5 is a working principle diagram of a control unit of a multifunctional nursing mattress provided by embodiment 1.
Figure 6:
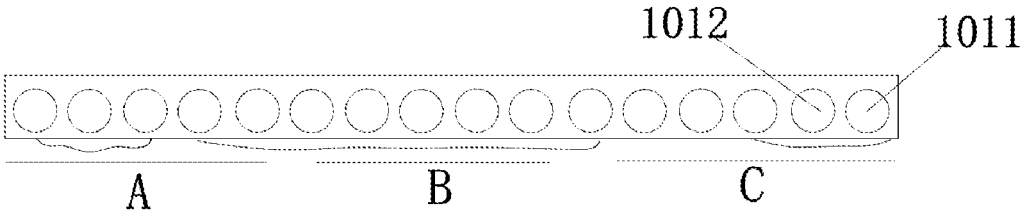
FIG. 6 is a schematic diagram of the multifunctional nursing mattress provided by embodiment 1 in the flat lying mode.
Figure 7:
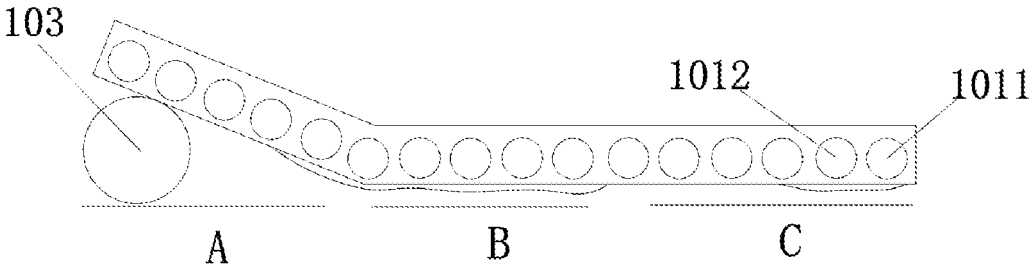
FIG. 7 is a schematic diagram of the multifunctional nursing mattress in the back lifting mode provided by embodiment 1.
Figure 8:
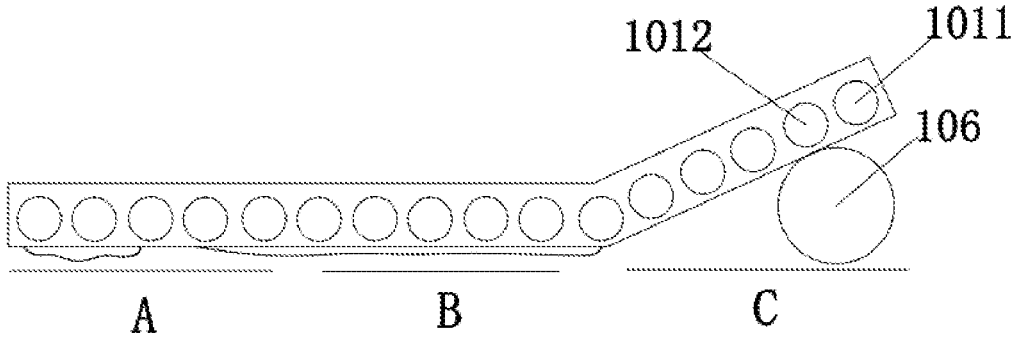
FIG. 8 is a schematic diagram of the multifunctional nursing mattress in the foot lifting mode provided by embodiment 1.
Figure 9:
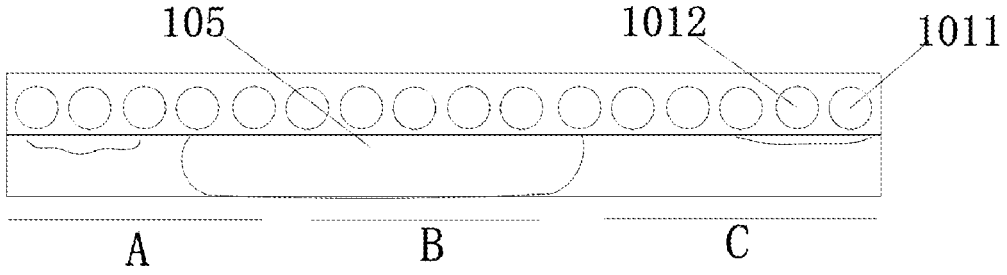
FIG. 9 is a schematic diagram of the multifunctional nursing mattress provided by embodiment 1 in the right-side overturning mode.

In this embodiment, as shown in FIG. 4, the control unit 208 is a PCB control board, on which multiple control modules are integrated to control the inflation and deflation of each airbag on the mattress. Specifically, as shown in FIG. 5, the control unit 208 mainly includes a weight recording module 2082, a posture selection module 2083, a pressure control module 2081, an alarm module 2084 and a timing module 2085.

The weight recording module 2082 is used to input the weight of the user and send the weight information to the pressure control module 2081.

The posture selection module 2083 is used to select the posture mode required by the user and send the selected posture mode information to the pressure control module 2081. The posture mode includes the lying down mode, the back lifting mode, the left-side overturning mode, the right-side overturning mode and the leg lifting mode, corresponding to the control of the inflation or the deflation of the inflatable airbag 101, the back lifting inflatable airbag 103 and the left-side overturning inflatable airbag 104, the right-side overturning inflatable airbag 105 and the foot lifting inflatable airbag 106.

According to the weight information sent by the weight recording module 2082 and the posture mode information sent by the posture selection module 2083, the pressure control module 2081 controls the air pump 207 to perform the preset inflation operation to the corresponding airbag through the air distribution valve 209. The pressure control module 2081 is provided with a pressure control sensor, which will stop the inflation of the corresponding tube when the air pressure reaches the preset value, so as to avoid the danger of the airbag bursting caused by excessive pressure.

The alarm module 2084 is used to send an alarm information to the pressure control module 2081 and give an alarm when the inflatable airbag 101, the back lifting inflatable airbag 103, the left-side overturning inflatable airbag 104, the right-side overturning inflatable airbag 105 and the foot lifting inflatable airbag 106 of the inflatable device 20 or air bed are abnormal. Specifically, the alarm module 2084 will give an alarm in case of power failure and air leakage, and the alarm sound is different, so it can judge whether it is power failure or air leakage through the sound. In addition, a control panel electrically connected with the PCB control board is provided with a button to cancel the alarm sound. If the alarm is cancelled and the problem of air leakage has not been solved, that is, the pressure still can not reach the preset value, the alarm module 2084 will detect again. If the air is not inflated to the preset pressure value within 4 minutes, a second alarm will be sent out.

The timing module 2085 is used to set the duration of maintaining a certain posture mode, or to set the timing in advance, so as to ensure that the user can adjust the posture at the preset time when there is no one for help, and can assist the user on the air bed to change the posture when there is no one to operate, so as to avoid the occurrence of bedsore.

It can be understood by those skilled in the art that the control unit 208 also includes a power module, that is, a master switch for connecting an external power supply and starting and closing the control unit 208. The above modules can be realized by adopting different circuit settings according to the actual needs, which are not limited to a specific way.

In this embodiment, the inflation device 20 does not inflate the left-side overturning inflatable tube airbag 204 or the right-side overturning inflatable airbag 205 at the same time, that is, there is only the left-side overturning mode or the right-side overturning mode can be selected at the same time, and the inflation device 20 inflates the left-side overturning inflatable airbag 204 or the right-side overturning inflatable airbag 205 at the same time, so as to avoid the human body being clamped due to the both sides lifting of the bed at the same time, and so as to ensure the safety.

In addition, when the inflation device 20 inflates the left-side overturning inflatable airbag 204 or the right-side overturning inflatable airbag 205, the posture selection module 2083 will send the corresponding command information to the pressure control module 2081, so that the foot lifting inflation tube 206 of the foot lifting inflatable airbag 106 inflated by the inflation device 20 is cut off and deflated. In other words, when the inflation device 20 inflates the left-side overturning inflatable airbag 204 or the right-side overturning inflatable airbag 205, there is no air inside the foot lifting inflatable airbag 106, and the inflation device 20 does not inflate the foot lifting inflatable airbag 106, so as to ensure the safety of the overturning posture.

In this embodiment, as shown in FIG. 2, the plurality of inflatable airbags 101 include a first inflatable airbag 1011 and a second inflatable airbag 1012, which are respectively communicated with the first inflation tube 201 and the second inflation tube 202 of the inflatable device 20, and the first inflatable airbag 1011 and the second inflatable airbag 1012 are arranged at intervals. The first inflatable airbag 1011 and the second inflatable airbag 1012 are separately inflated through the first inflation tube 201 and the second inflation tube 202. On the one hand, the inflation efficiency is improved, on the other hand, the separate inflation of the first inflatable airbag 1011 and the second inflatable airbag 1012 can also play a certain massage effect.

In the present embodiment, the mattress is provided with a rapid deflation structure for rapidly releasing the air in the first and second inflation tubes.

As a further improvement, as shown in FIG. 2 and FIG. 6-9, the plurality of inflatable airbags 101 located in the head rest area A and the back rest area B are evenly divided into two parts along the midline of the mattress body 10. The two parts can be folded relative to each other, and the two parts are communicated with each other, by providing this structure, the head rest area A and the back rest area B of the mattress body 10 can cooperate with the left-side overturning airbag 204 or the right-side overturning airbag 205 to rotate at a certain angle, so as to realize the turning over of the human body.

In addition, considering that the material of the airbag itself is soft and easy to move, resulting in dislocation, a plurality of limit clips 1015 symmetrically arranged at the bottom of the mattress body 10 are used to limit the inflatable airbag 101. The first buckle 1013 is arranged at the both sides of the mattress body 10, and each inflatable airbag 101 is transversely arranged in the mattress body 10 through the limit clips 1015, and each inflatable airbag 101 is provided with a second buckle 1014. By connection of the first buckle 1013 and the second buckle 1014 (as shown in FIG. 2), so as to complete the positioning of the inflatable airbag 101 and avoid the dislocation of the airbag.

As a further improvement, as shown in FIG. 3, two independent holding bags 1021 are arranged on the lower surface of the mattress cover 102 of the mattress body 10, and the two bottom plates 1022 are respectively arranged in the two holding bags 1021 to increase the strength of the whole mattress body 10 and support the mattress body 10, so as to avoid the deformation of the mattress body 10.

The working principle and main working process of the embodiment are as follows:

After the human body lies flat on the air bed S, the inflation device 20 is started. A control panel is electrically connected with the control unit 208, the weight of the human body on the air bed is input through the control panel and the corresponding posture mode is selected, and the weight parameter information and posture mode information are transmitted to the weight recording module 2082 and the posture selection module 2083 of the control unit 208, and finally, it is transmitted to the pressure control unit 2081. The pressure control unit 2081 inflates the corresponding inflatable bag of the air bed according to the received weight parameter information and posture mode information through the preset program, so as to realize the adjustment of human body posture, as shown in FIG. 6-FIG. 9.

Embodiment 2

Figure 10:
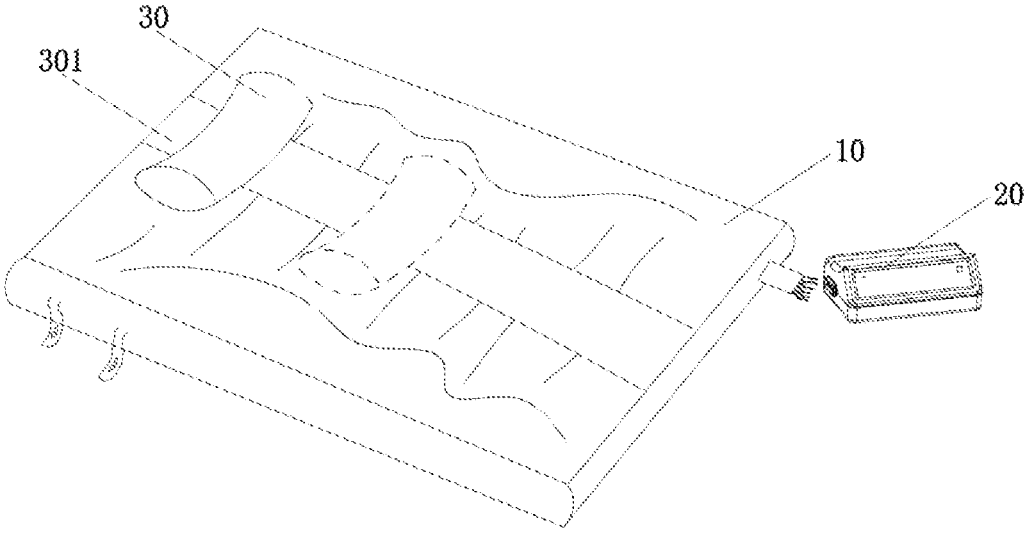
FIG. 10 is a structural diagram of a multifunctional nursing mattress provided by embodiment 2.

This embodiment is further improved on the basis of embodiment 1. A back cushion 30 is provided between the head rest area A and the back rest area B on the upper surface of the mattress body 10. The back cushion 30 is connected with the mattress cover 102 of the mattress body 10 through a regulating belt 301. As shown in FIG. 10, the regulating belt 301 is arranged along the length direction of the mattress body 10, the back cushion 30 is slidably arranged on the regulating belt 301, and a fixed structure is arranged between the regulating belt 301 and the back cushion 30, so that the back cushion 30 can move between the head rest area A and the back rest area B of the mattress body 10, and can be fixed on the regulating belt 301. When the back cushion 30 is located in the head rest area A, the back cushion 30 acts as a neck pillow. When the user adopts the back lifting mode, there is a certain space between the waist of the user and the mattress body 10. At this time, the back cushion 30 can be moved to the back rest area B as a back cushion for the user to support the back of the user and make the waist experience more comfortable.

In this embodiment, a plurality of buckles can be arranged on the regulating belt 301, the buckles are usually hidden in the regulating belt, a slide block is arranged on the regulating belt 301, the middle position on the back of the back cushion 30 is detachably connected with the slide block, and another buckle is arranged on the back of the back cushion 30 to match with the buckle of the regulating belt 301 for positioning. In other embodiments, velcro can also be used to fix the back cushion 30 and the regulating belt 301. Or an insertion hole may be set in the regulating belt 301, and the corresponding insertion pin is set on the back of the back cushion 30, the two are connected in the form of embedded buckle, which is not limited to this embodiment.

Embodiment 3

Figure 11:
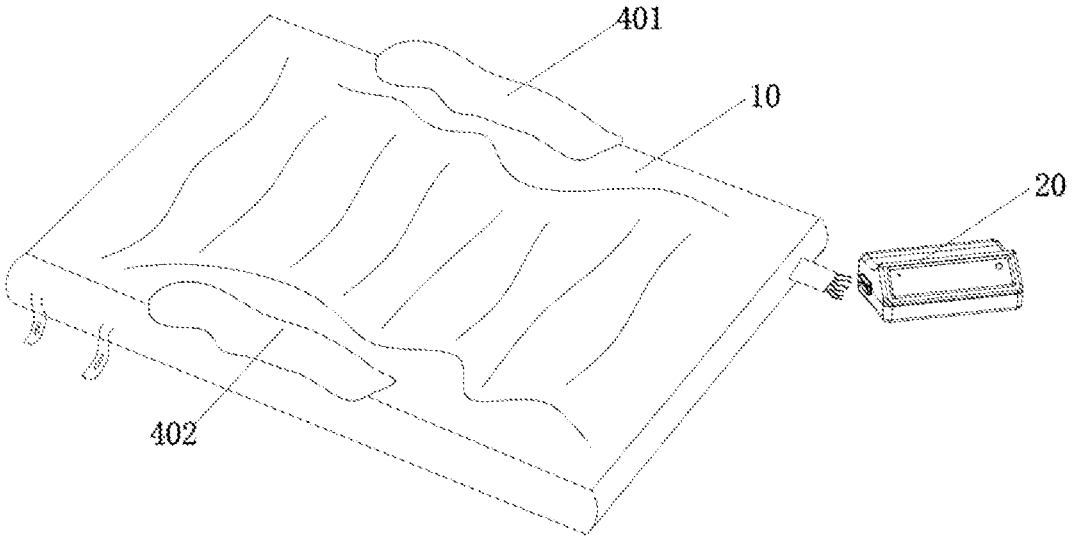
FIG. 11 is a structural diagram of a multifunctional nursing mattress provided by embodiment 3.

This embodiment is further improved on the basis of embodiment 1, and the structure of embodiment 2 can also be applied to the air bed of this embodiment. The specific improvements of this embodiment are as follows:

As shown in FIG. 11, a left inflatable pad 401 and a right inflatable pad 402 are added on both sides of the mattress body 10. The left inflatable pad 401 and the right inflatable pad 402 are detachably installed on both sides of the mattress body 10, and can be fixed on the mattress body 10 in the form of Velcro or buckle.

Figure 14:
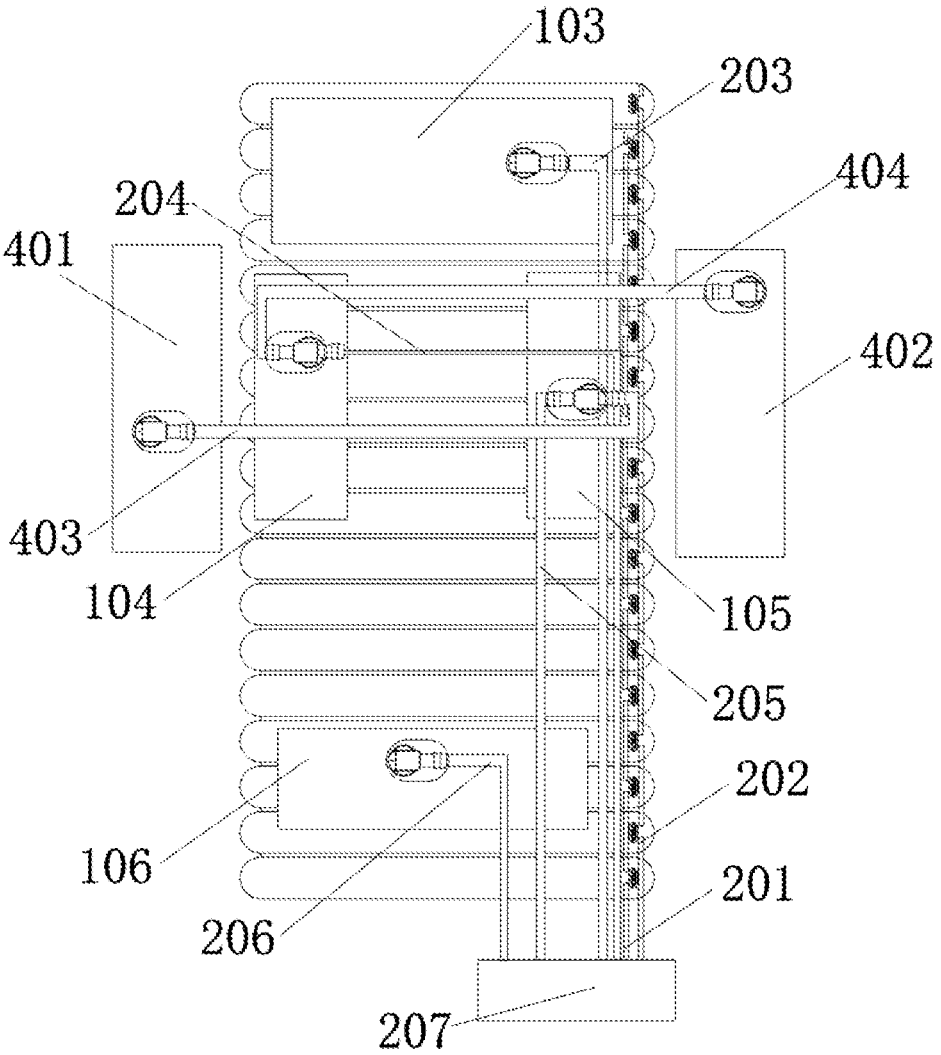
FIG. 14 is a schematic diagram of the connection between each inflatable bag and the inflation tube in the third embodiment 3.

Correspondingly, the inflation device 20 also includes a left pad inflation tube 403 and a right pad inflation tube 404 for inflating the left inflatable pad 401 and the right inflatable pad 402 respectively. That is to say, the air pump 207 is not only provided with the first inflation tube 201, the second inflation tube 202, the back lifting inflation tube 203, the left-side overturning inflation tube 204, the right-side overturning inflation tube 205 and the foot lifting inflation tube 206, and but also provided with the left pad inflation tube 403 and the right pad inflation tube 404. The left pad inflation tube 403 and the right pad inflation tube 404 are added by replacing the single nozzle connecting valve at the bottom of the right-side overturning inflation tube 205 and the left-side overturning inflation tube 204 with the double nozzle connecting valve. As shown in FIG. 14, the left pad inflation tube 403 is communicated with the right-side overturning inflation tube 205, and the right pad inflation tube 404 is connected with the left-side overturning inflation tube 204.

Figure 12:
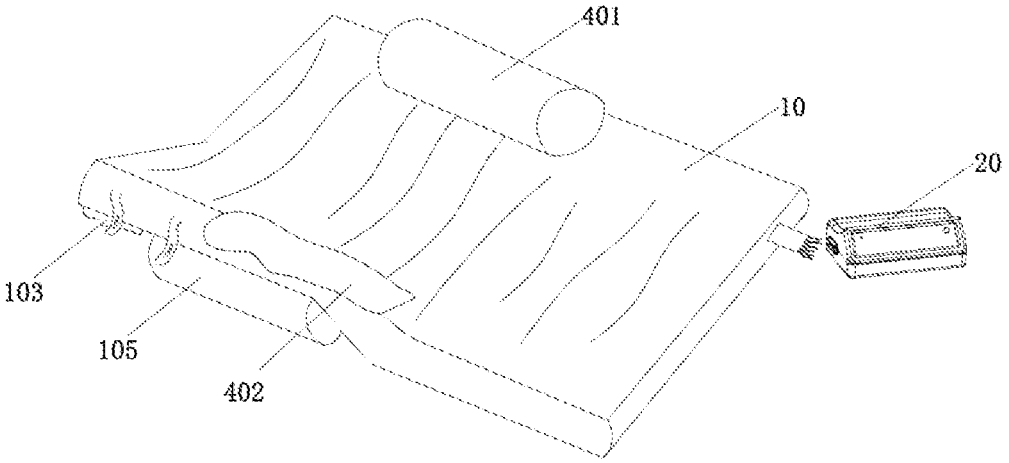
FIG. 12 is a schematic diagram of the multifunctional nursing mattress provided by embodiment 3 when it is in the right-side overturning mode.
Figure 13:
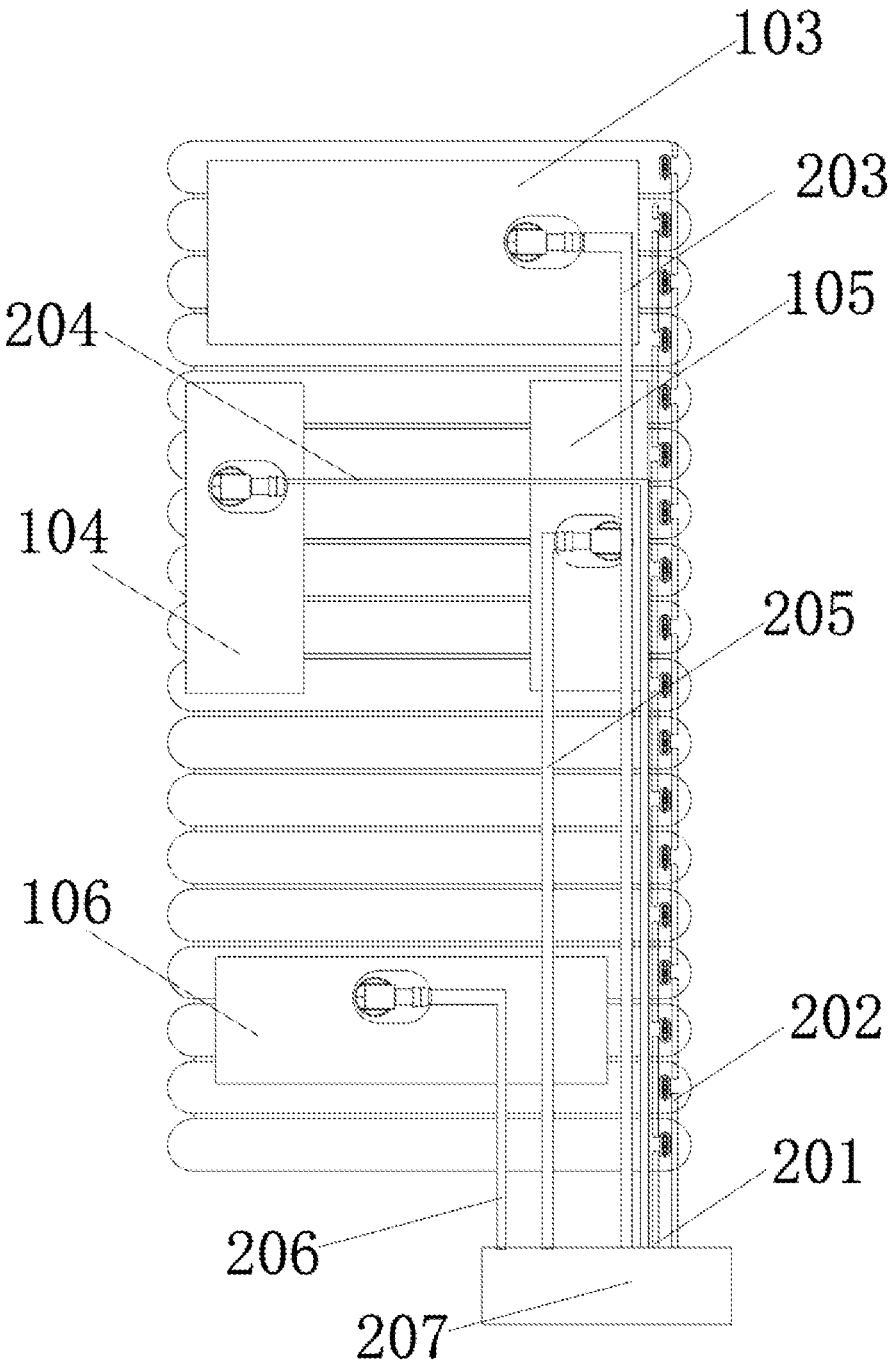
FIG. 13 is a schematic diagram of the connection between each inflatable bag and the inflation tube in embodiment 1.

In specific use, as shown in FIG. 12, taking the right turn over posture as an example, the inflation device 20 inflates the right-side overturning inflation tube 205 to turn over the right side of the air bed S. At the same time, because the left pad inflation tube 403 is communicated with the right-side overturning inflation tube 205, the left pad inflation tube 403 is inflated while the right-side overturning inflatable bag 105 is inflated, thus playing a protective function. At the same time, the user can hold the left pad inflation tube 403 after turning over, which makes the use experience more comfortable.

By setting the left inflatable pad 401 and the right inflatable pad 402, the safety of the user is improved in the process of turning left or right. At the same time, the left inflatable pad 401 and the right inflatable pad 402 can also play the role of a pillow after inflation. After the body turning over, the user can hold the left inflatable pad 401 or the right inflatable pad 402, and the use experience is more comfortable. And when lying flat, the two side pads are not inflated to facilitate getting out of bed, which improves the safety and ensures the convenience.

The above is only the preferred embodiment of the present invention, and is not used to limit the present invention. For those skilled in the art, the present invention can have various changes. Any modification, equivalent replacement, improvement within the spirit and principle of the present invention shall be included in the protection scope of the present invention.

What is claimed is:

1. A multifunctional nursing mattress, comprising a mattress body, wherein the mattress body is divided into a head rest area, a back rest area and a leg rest area according to a position of human body lying flat on the mattress body; the mattress body comprises a plurality of inflatable bags arranged inside in parallel, a mattress cover wrapping the plurality of inflatable bags, and a back lifting inflatable bag, a left-side overturning inflatable bag, a right-side overturning inflatable bag and a foot lifting inflatable bag, wherein the back lifting inflatable bag, the left-side overturning inflatable bag, the right-side overturning inflatable bag and the foot lifting inflatable bag are arranged under the mattress body;

an inflation device, wherein the inflation device is configured to inflate and deflate the plurality of inflatable bags, the back lifting inflatable bag, the left-side overturning inflatable bag, the right-side overturning inflatable bag and the foot lifting inflatable bag, comprising a first inflation tube, a second inflation tube, a back lifting inflation tube, a left-side overturning inflation tube, a right-side overturning inflation tube, a foot lifting inflation tube, and an air pump, a control unit for controlling the air pump;

wherein, the inflation device does not inflate the left-side overturning inflatable bag or the right-side overturning inflatable bag at the same time, and when the inflation device inflates the left-side overturning inflatable bag or the right-side overturning inflatable bag, the foot lifting air tube of the foot lifting inflatable bag is cut off by the inflation device;

the air pump is provided with an air distribution valve communicated with the first inflation tube and the second inflation tube, the back lifting inflation tube, the left-side overturning inflation tube, the right-side overturning inflation tube and the foot lifting inflation tube respectively;

wherein a back cushion is arranged in the back rest area of the upper surface of the mattress body, and the back cushion is connected with the mattress body through a regulating belt, two ends of the regulating belt are arranged at a middle of the mattress body and along a length direction of the mattress body, the back cushion is able to move up and down in the back rest area of the mattress body;

both sides of the mattress body are also provided with a left inflatable pad and a right inflatable pad, and the left inflatable pad and the right inflatable pad are detachably installed on both sides of the mattress body; and the inflation device further comprises a left pad inflation tube and a right pad inflation tube for inflating the left inflatable pad and the right inflatable pad respectively, wherein the left pad inflation tube is communicated with the right-side overturning inflation tube, and the right pad inflation tube is communicated with the right-side overturning inflation tube.

2. The multifunctional nursing mattress according to claim 1, wherein the plurality of inflatable bags comprises a first inflatable bag and a second inflatable bag, which are respectively communicated with the first inflation tube and the second inflation tube of the inflation device, and the first inflatable bag and the second inflatable bag are arranged at intervals.

3. The multifunctional nursing mattress according to claim 1, wherein a shape of the back lifting inflatable bag after inflation is circular or triangular.

4. The multifunctional nursing mattress according to claim 1, wherein the control unit comprises a weight recording module, a posture selection module, a pressure control module and an alarm module, wherein the weight recording module is configured for inputting a weight of an user and sending the weight information of the user to the pressure control module;

the posture selection module is configured to select a posture mode required by the user, and send the selected posture mode information to the pressure control module, wherein the posture mode comprises a lying down mode, a back lifting mode, a left-side overturning mode, a right-side overturning mode and a leg lifting mode, respectively corresponding to the control of the plurality of the inflatable bags, the back lifting inflatable bag, the left-side overturning inflatable bag, the right-side overturning inflatable bag and foot lifting inflatable bag;

the pressure control module is configured to control the air pump to perform preset inflation operation to the corresponding inflatable bag through the air distribution valve according to the weight information sent by the weight recording module and the posture mode information sent by the posture selection module, and the pressure control module is provided with an air pressure control sensor, an inflation process of the corresponding inflation tube is stopped when the air pressure reaches a preset value;

the alarm module is configured to send an alarm information to the pressure control module when the plurality of the inflatable bags, the back lifting inflatable bag, the left-side overturning inflatable bag, the right-side overturning inflatable bag and the foot lifting inflatable bag of the inflation device or the air bed are abnormal.

5. The multifunctional nursing mattress according to claim 1, wherein two independent holding bags are arranged on a lower surface of the mattress cover of the mattress body, and two base plates are respectively arranged in the two holding bags to increase a strength of the whole mattress body and support the mattress body, so as to avoid a deformation of the mattress body.

6. The multifunctional nursing mattress according to claim 1, wherein a spring is built in a position of each inflation tube near the air distribution valve to avoid the tube bending, so as to maintain the tube shape and make the inflation device more miniaturized.

7. The multifunctional nursing mattress according to claim 1, wherein an air inlet of the air pump of the inflation device is provided with silencing cotton to reduce the working noise.

8. The multifunctional nursing mattress according to claim 1, wherein a silicone pad is arranged between a bottom of a shell of the inflation device and the air pump to slow down a vibration of the air pump.

9. The multifunctional nursing mattress according to claim 1, wherein the plurality of the inflatable bags located in the head rest area and the back rest area are evenly divided into two parts along a midline of the mattress body, the two parts is foldable relative to each other, and the two parts are communicated with each other.

10. The multifunctional nursing mattress according to claim 1, wherein a plurality of limit clips symmetrically arranged at the bottom of the mattress body are used to limit the plurality of the inflatable bags, a first buckle is arranged at both sides of the mattress body, and each of the plurality of the inflatable bags is transversely arranged inside the mattress body through the limit clips, and each of the plurality of the inflatable bags is provided with a second buckle, and each of the plurality of the inflatable bags is positioned by the first buckle and the second buckle.

11. The multifunctional nursing mattress according to claim 1, wherein a detachable connector is arranged between the air distribution valve and each inflation tube, the connector is embedded on a shell of the inflation device, and the connector is provided with connection holes with the same number of the inflation tubes.

* * * * *